US009491827B2

(12) United States Patent
Aliakseyeu et al.

(10) Patent No.: US 9,491,827 B2
(45) Date of Patent: Nov. 8, 2016

(54) METHODS AND APPARATUS FOR CONTROLLING LIGHTING

(71) Applicant: KONINKLIJKE PHILIPS N.V., Eindhoven (NL)

(72) Inventors: Dzmitry Viktorovich Aliakseyeu, Eindhoven (NL); Philip Steven Newton, Waalre (NL); Bartel Marinus Van De Sluis, Eindhoven (NL); Ramon Antoine Wiro Clout, Eindhoven (NL); Tatiana Aleksandrovna Lashina, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/768,559

(22) PCT Filed: Feb. 11, 2014

(86) PCT No.: PCT/IB2014/058893

§ 371 (c)(1),
(2) Date: Aug. 18, 2015

(87) PCT Pub. No.: WO2014/128594

PCT Pub. Date: Aug. 28, 2014

(65) Prior Publication Data

US 2016/0007423 A1 Jan. 7, 2016

Related U.S. Application Data

(60) Provisional application No. 61/766,369, filed on Feb. 19, 2013.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.
CPC ..... *H05B 33/0863* (2013.01); *H05B 33/0845* (2013.01); *H05B 37/0245* (2013.01)

(58) Field of Classification Search
None
See application file for complete search history.

(56) References Cited

U.S. PATENT DOCUMENTS

| | | | | |
|---|---|---|---|---|
| 6,016,038 | A | 1/2000 | Mueller et al. | |
| 6,211,626 | B1 | 4/2001 | Lys et al. | |
| 9,114,060 | B2 * | 8/2015 | Ciechanowski | A61H 33/005 |
| 2011/0089857 | A1 * | 4/2011 | Diederiks | H05B 37/0209 315/291 |
| 2013/0266325 | A1 * | 10/2013 | Giustiniano | H04B 10/116 398/130 |

FOREIGN PATENT DOCUMENTS

| | | | |
|---|---|---|---|
| DE | 102011079312 | A1 | 1/2013 |
| WO | 2009004539 | A1 | 1/2009 |

(Continued)

*Primary Examiner* — Anh Tran
(74) *Attorney, Agent, or Firm* — Meenakshy Chakravorty

(57) ABSTRACT

Disclosed are methods and apparatus for lighting control. Presence of a lighting control element (110, 310, 312A-C, 510, 512, 610, 710, 915, 917) is identified over one or more LEDs (323, 327, 930) and at least one lighting control property of the lighting control element is identified. At least one property of light output of controlled light sources associated with the lighting control element is adjusted based on the lighting control property of the lighting control element. The lighting control element may be a user interface element.

19 Claims, 4 Drawing Sheets

(56) References Cited

FOREIGN PATENT DOCUMENTS

| | | | |
|---|---|---|---|
| WO | 2011030292 | A1 | 3/2011 |
| WO | 2012035469 | A1 | 3/2012 |
| WO | 2012038875 | A2 | 3/2012 |
| WO | 2012101541 | A2 | 8/2012 |

* cited by examiner

METHODS AND APPARATUS FOR CONTROLLING LIGHTING

CROSS-REFERENCE TO PRIOR APPLICATIONS

This application is the U.S. National Phase application under 35 U.S.C. §371 of International Application No. PCT/IB2014/058893, filed on Feb. 11, 2014, which claims the benefit of U.S. Provisional Patent Application No. 61/766,369, filed on Feb. 19, 2013. These applications are hereby incorporated by reference herein.

TECHNICAL FIELD

The present invention is directed generally to lighting control. More particularly, various inventive methods and apparatus disclosed herein relate to controlling one or more properties of light output based on one or more identified properties of an attached lighting control element.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038 and 6,211,626, incorporated herein by reference.

In lighting systems, such as those that include LED-based light sources, it is desirable to have control over one or more light sources of the lighting system. For example, it may be desirable to have on/off control of one or more light sources of the lighting system and/or control of one or more lighting parameters of one or more of the light sources. More particularly, it may be desirable to have control of a lighting scene, lighting direction, lighting color, illumination intensity, beam width, beam angle, and/or other parameters of one or more of the light sources.

Direct specification during configuration of the one or more light sources enables selection of desirable lighting parameters. However, such direct specification may suffer from one or more drawbacks such as lack of ability to fine-tune applied lighting, lack of flexibility for adapting to newly introduced environmental objects and/or relocation of existing objects, and/or lack of tailoring of lighting parameters and/or adjustments to specific objects. Control switches connected to a mains power supply also enable control of one or more light sources. However, such control switches may suffer from one or more drawbacks such as requiring connection to the mains power supply, which may present constraints on where the control switches may be installed. Smart phones and tablets also enable control of one or more light sources. However, such control may suffer from one or more drawbacks such as the need to locate the remote device to control the light source and/or interference with other activities of the remote device. Additional and/or alternative drawbacks of direct specification, control switches, smart phones, and/or tablets may be presented.

Thus, there is a need in the art to provide methods and apparatus that enable control of one or more properties of light output and that optionally overcome one or more drawbacks of existing user interfaces.

SUMMARY

The present disclosure is directed to lighting control. More particularly, various inventive methods and apparatus disclosed herein relate to controlling one or more properties of light output based on one or more identified properties of an attached lighting control element. For example, in some embodiments, presence of a lighting control element is identified over one or more LEDs and at least one lighting control property of the lighting control element is identified. At least one property of light output of controlled light sources associated with the lighting control element is adjusted based on the lighting control property of the lighting control element. The lighting control element may be a user interface element.

Generally, in one aspect a method of associating a user interface element with at least one light source is provided and includes the steps of: identifying presence of a user interface element over one or more covered LEDs of a plurality of LEDs; associating the user interface element with control of controlled LEDs of the LEDs based on the presence identification of the user interface element; identifying at least one lighting control property of the user interface element; identifying a user interaction with the user interface element; and adjusting at least one property of the controlled LEDs in response to the user interaction with the user interface element, wherein the adjusting of the controlled LEDs is based on the lighting control property of the user interface element.

In some embodiments, the step of identifying the user interaction with the user interface element includes sensing of the user interaction with the user interface element by at least one of the covered LEDs.

In some embodiments, the step of identifying the user interaction with the user interface element includes receiving user interaction data from the user interface element in response to the user interaction with the user interface element.

In some embodiments, the step of identifying the lighting control property of the user interface element is based on sensing of at least one physical characteristic of the user interface element via at least one of the covered LEDs. In some versions of those embodiments the physical characteristic includes at least one of size and shape of the user interface element.

In some embodiments, the step of associating the user interface element with control of controlled LEDs is based on proximity of the user interface element to the controlled LEDs.

In some embodiments, the step of associating the user interface element with control of controlled LEDs is based on association of the covered LEDs with the controlled LEDs.

In some embodiments, the step of associating the user interface element with control of controlled LEDs is based on at least one physical characteristic of the user interface element. In some versions of those embodiments the at least one physical characteristic is a radio-frequency tag.

In some embodiments, the step of associating the user interface element with control of the controlled LEDs includes: initiating a configuration phase; providing a visual indication of the controlled LEDs during the configuration phase; and receiving a configuration confirmation in response to the visual indication of the controlled LEDs during the configuration phase, the configuration confirmation indicative of associating the user interface element with control of the controlled LEDs. In some versions of those embodiments the configuration confirmation is received via the user interface element. Optionally, the visual indication of the controlled LEDs is preceded by at least one additional visual indication of a unique set of the LEDs, and receiving the configuration confirmation via the user interface element during the visual indication of the unique set of the LEDs associates the user interface element with control of the unique set of LEDs.

In some embodiments the method further includes illuminating the user interface element with at least one of the covered LEDs.

In some embodiments the user interface element is attachable over the covered LEDs. In some versions of those embodiments the user interface element is adhesively attachable over the covered LEDs.

Generally, in another aspect, a method of adjusting at least one light source in response to an attachable element is provided and includes the steps of: identifying presence of an attachable element over one or more covered LEDs of a plurality of LEDs; associating the attachable element with controlled LEDs of the LEDs based on the presence identification of the attachable element; identifying at least one lighting control property of the attachable element; and adjusting at least one property of the controlled LEDs based on the at least one lighting control property of the attachable element.

In some embodiments the step of identifying the lighting control property of the attachable element is based on sensing of at least one physical characteristic of the attachable element by at least one of the covered LEDs. In some versions of those embodiments the physical characteristic includes at least one of size and shape of the attachable element.

In some embodiments the step of associating the attachable element with the controlled LEDs is based on proximity of the attachable element to the controlled LEDs.

In some embodiments the step of associating the attachable element with control of controlled LEDs is based on association of the covered LEDs with the controlled LEDs.

In some embodiments the step of associating the attachable element with the controlled LEDs is based on of at least one physical characteristic of the attachable element. In some versions of those embodiments the at least one physical characteristic includes at least one of size and shape.

In some embodiments, the controlled LEDs are substantially surrounded by the covered LEDs and/or produce a light output directed primarily toward the attachable element.

In some embodiments, the method further includes identifying a user interaction with the attachable element, and the adjusting at least one property of the controlled LEDs is in response to the user interaction with the user interface element.

Generally, in another aspect, a lighting apparatus is provided that includes a memory and a controller operable to execute instructions stored in the memory. The instructions comprise instructions to: identify presence of a user interface element over one or more covered LEDs of a plurality of LEDs; associate the user interface element with control of controlled LEDs of the LEDs based on the presence identification of the user interface element; identify at least one lighting control property of the user interface element; identify a user interaction with the user interface element; and adjust at least one property of the controlled LEDs in response to the user interaction with the user interface element, wherein the adjusting of the controlled LEDs is based on the lighting control property of the user interface element.

Generally, in another aspect, a lighting system is provided that includes: at least one light source generating lighting having at least one adjustable lighting property; at least one sensing LED configured to sense presence of a user interface element; and at least one controller in electrical communication with the light source and the sensing LED. The at least one controller: identifies presence of the user interface element based on input from the at least one sensing LED; associates the user interface element with control of the light source based on the presence identification of the user interface element; identifies at least one lighting control property of the user interface element; identifies a user interaction with the user interface element; and adjusts at least one property of the controlled LEDs in response to the user interaction with the user interface element. The adjusting of the controlled LEDs is based on the lighting control property of the user interface element.

Other embodiments may include a non-transitory computer readable storage medium storing instructions executable by a processor to perform a method such as one or more of the methods described herein. Yet other embodiments may include a system including memory and one or more processors operable to execute instructions, stored in the memory, to perform a method such as one or more of the methods described herein.

As used herein for purposes of the present disclosure, the term "LED" should be understood to include any electroluminescent diode or other type of carrier injection/junction-based system that is capable of generating radiation in response to an electric signal and/or acting as a photodiode. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

The term "user interface element" as used herein refers to a passive or active device that may be provided over one or more LEDs and utilized to control, for example, other light sources and/or other systems or devices. Some embodiments of a user interface may be a user interface element.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
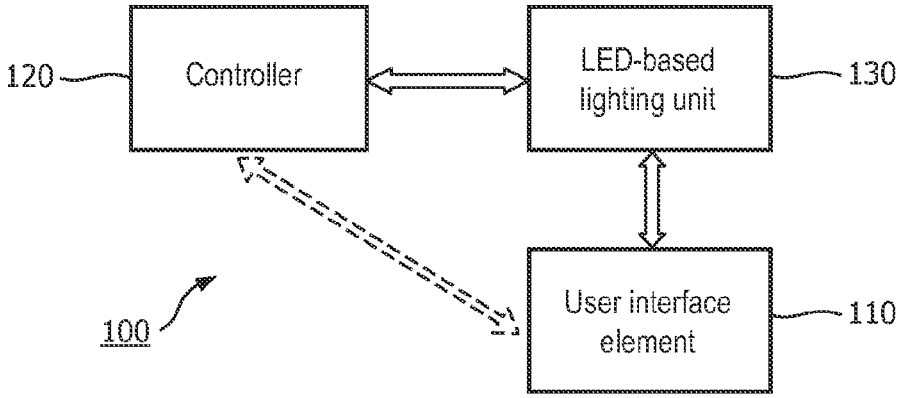
FIG. 1 illustrates a block diagram of an embodiment of a LED-based lighting system having a controller, LEDs, and a user interface element.

In lighting systems such as those that include LED-based light sources, it is desirable to have control over one or more light sources of the lighting system. For example, it may be desirable to have control of a lighting scene, lighting direction, lighting color, illumination intensity, beam width, beam angle, and/or other parameters of one or more of the light sources. Direct specification during configuration of the one or more light sources, control switches connected to a mains power supply, and/or smart phones and tablets may each enable selection of one or more lighting parameters. However, such direct specification may suffer from one or more drawbacks such as lack of ability to fine-tune applied lighting, lack of flexibility, and/or lack of tailoring of lighting parameters. Also, control switches may suffer from one or more drawbacks such as requiring connection to the mains power supply. Also, smart phones and/or tablets may suffer from one or more drawbacks such as the need to locate the remote device to control the light source and/or interference with other activities of the remote device.

Thus, Applicants have recognized and appreciated a need in the art to provide methods and apparatus that enable control of one or more properties of light output and that optionally overcome one or more drawbacks of existing user interfaces.

More generally, Applicants have recognized and appreciated that it would be beneficial to provide various inventive methods and apparatus related to controlling one or more properties of light output based on one or more identified properties of an attached lighting control element.

In view of the foregoing, various embodiments and implementations of the present invention are directed to lighting control.

In the following detailed description, for purposes of explanation and not limitation, representative embodiments disclosing specific details are set forth in order to provide a thorough understanding of the claimed invention. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatus and methods may be omitted so as to not obscure the description of the representative embodiments. Such methods and apparatus are clearly within the scope of the claimed invention. For example, aspects of the methods and apparatus disclosed herein are described in conjunction with a lighting system having only LED-based light sources. However, one or more aspects of the methods and apparatus described herein may be implemented in other lighting systems that additionally and/or alternatively include other non-LED light sources. Implementation of the one or more aspects described herein in alternatively configured environments is contemplated without deviating from the scope or spirit of the claimed invention. Also, for example aspects of the methods and apparatus disclosed herein are described in conjunction with a single controller and single lighting unit. However, one or more aspects of the methods and apparatus described herein may be implemented in other lighting systems that may include multiple controllers and/or multiple lighting units. Also, for example aspects of the methods and apparatus disclosed herein are described in conjunction with adjusting one or more property of LEDs in response to user interaction with a user interface element. However, one or more aspects of the methods and apparatus described herein may be implemented in systems that may additionally and/or alternatively adjust one or more properties of other apparatus (e.g., blinds, a heater, an air conditioner) in response to user interaction with a user interface element in accordance with teachings hereof.

FIG. 1 illustrates a block diagram of an embodiment of a LED-based lighting system 100. The lighting system 100 includes a controller 120 controlling a plurality of LEDs of at least one LED-based lighting unit 130. The LED-based lighting unit 130 includes one or more LEDs that are configured to generate light output. The control of the LEDs of the LED-based lighting unit 130 is based at least in part on input from a user interface element 110. In some embodiments user interactions with the user interface element 110 may be communicated to the controller 120 via the LEDs of the LED-based lighting unit 130. For example, as described herein, in some embodiments the LEDs may include one or more LEDs that are operable in a sensing mode and the LEDs may sense user interaction with the user interface element 110 and communicate that user interaction to the controller 120. In some embodiments user interaction with the user interface element 110 may additionally and/or alternatively be communicated to the controller 120 by the user interface element 110 without use of the LEDs. For example, user interface element 110 may utilize one or more wireless communications apparatus and methods to communicate directly with the controller 120.

In some embodiments the initial configuration of the user interface element 110 may be achieved via one or more readings from the LEDs of the LED-based lighting unit 130. For example, in some embodiments the LEDs may be utilized in detecting presence of the user interface element 110, associating the user interface element 110 with control of certain LEDs, and/or identifying a lighting control property of the user interface element 110.

The controller 120 controls the LED-based lighting unit 130 based on signals received from the user interface element 110. In some embodiments the LEDs of the LED-based lighting unit 130 are driven by one or more drivers and the controller 120 communicates with the one or more drivers to control the LEDs. In some embodiments the controller 120 may form part of the driver for the LED-based lighting unit 130. In some embodiments the controller 120 communicates with one or more local controllers of the LED-based lighting unit 130 to control the LEDs. For example, a plurality of local controllers may be provided, each controlling one or more LEDs of the LED-based lighting unit 130. In some embodiments the controller 120 itself may include a plurality of local controllers, each controlling one or more LEDs of the LED-based lighting unit 130. The controller 120 may control a single group of LEDs of the LED-based lighting unit 130 or may control multiple groups of LEDs. Embodiments including multiple controllers may optionally incorporate wired and/or wireless communication between the multiple controllers.

In some embodiments the LED-based lighting unit 130 may include a plurality of LED groupings each including one or more of the LEDs. For example, in some embodiments the LED groupings may each include at least one surface of LEDs (e.g., on a wall, ceiling, column, or other surface) and/or one or more portions of a surface of LEDs. A surface of LEDs may include a flat surface, an arcuate surface, a multi-faceted surface, and/or other surface that includes one or more LEDs. Some examples of surfaces of LEDs include a wall, a ceiling, a floor, a column (e.g., a round column, a square column, an elliptical column). One or more aspects of the control of each of the LED groupings may optionally be specific to the individual LED grouping. The LED-based lighting unit 130 may also include one or more sensors that are utilized to detect presence of the user interface element 110, associate the user interface element 110 with control of certain LEDs, identify a lighting control property of the user interface element 110, and/or detect user interaction with the user interface element 110. In some embodiments the one or more sensors utilized to detect presence of the user interface element 110, associate the user interface element 110 with control of certain LEDs, identify a lighting control property of the user interface element 110, and/or detect user interaction with the user interface element 110 may include one or more LEDs of the LED-based lighting unit 130 that may be configured to sense light incident thereon. In some embodiments the LEDs configured to sense light may also be configured to generate light output. For example, the LEDs may generate light output in a first mode and be capable of sensing light when they are not in the first mode.

Figure 2:
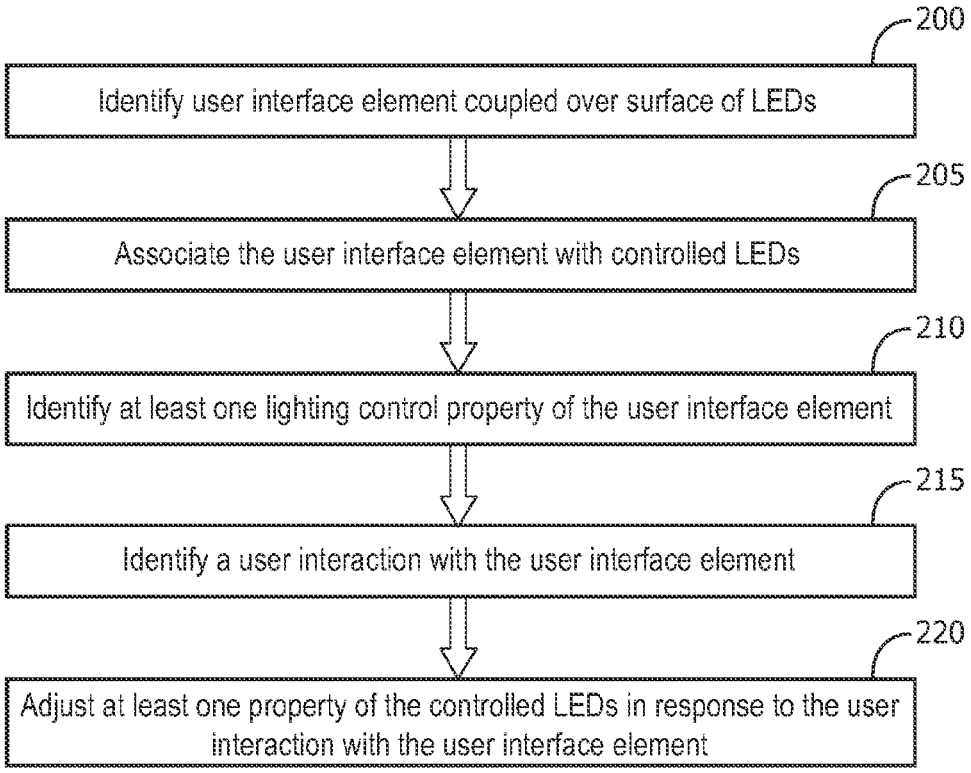
FIG. 2 illustrates a flow chart of an example method of associating a user interface element with one or more LEDs.

Referring to FIG. 2, a flow chart of an example method of associating a user interface element with one or more LEDs is illustrated. Other implementations may perform the steps in a different order, omit certain steps, and/or perform different and/or additional steps than those illustrated in FIG. 2. For convenience, aspects of FIG. 2 will be described with reference to one or more components of a lighting system that may perform the method. The components may include, for example, one or more of the components of lighting system 100 of FIG. 1 and/or one or more components of FIGS. 3-7. Accordingly, for convenience, aspects of FIGS. 1 and 3-7 will be described in conjunction with FIG. 2.

At step 200 a user interface element coupled over a surface of LEDs is identified. For example, with reference to FIG. 1, the user interface element 110 may be coupled over one or more of the LEDs of the LED-based lighting unit 130 and presence of the user interface element 110 identified. Also, for example, with reference to FIG. 3, the user interface elements 310, 312A, 312B, and/or 312C may be coupled over the surface of LEDs 320 and presence thereof identified. In some embodiments a user may attach the user interface element to any desired location on a surface of LEDs. In some embodiments one or more user interface element attachment locations may be indicated. In some embodiments the user interface element may include an adhesive that enables adhering of the user interface element to the surface of LEDs.

In some embodiments one or more of the LEDs of the surface of LEDs may be utilized to identify the user interface element. For example, sensed light values of one or more sensing LEDs may be indicative of whether a user interface element is attached to the LED surface over such LEDs. In some embodiments at least one sensed light value of one or more LEDs may be compared to at least one or more baseline light values (e.g., empirical and/or measured in a calibration mode with no user interface elements present) to determine whether a user interface element is attached to the LED surface. For example, in some embodiments at least one sensed light value at one or more LEDs over which the user interface element is attached may be compared to one or more sensed light values at those LEDs before the user interface element was attached.

For example, a LED may be operated in a sensing mode prior to attachment of the user interface element and a first value for the LED determined based on at least one first sensed light value prior to attachment of the user interface element. The first sensed light value may sense light incident on the LED in the sensing mode from other light sources directed toward the LED and/or from natural lighting incident on the LED. The LED may also be operated in a sensing mode after attachment of the user interface element and a second value for the LED determined based on at least one second sensed light value after attachment of the user interface element. The second sensed light value may be indicative of less light due to the user interface element occluding at least some of the light that would otherwise be incident on the LED. The second value may be compared to the first value to determine if a user interface element is attached over the LED. For example, if a difference between the first value and the second value satisfies a threshold, then it may be determined that a user interface element is attached over the LED.

Figure 3:
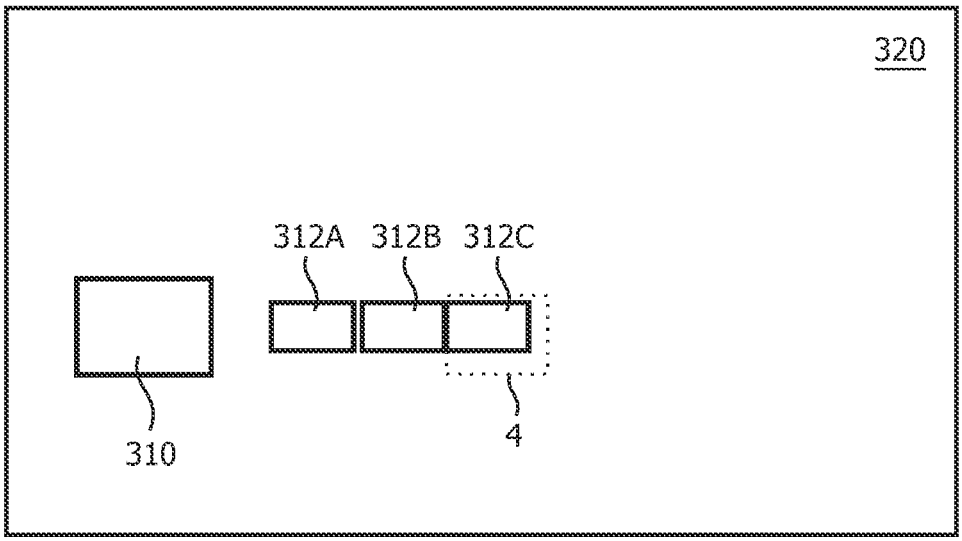
FIG. 3 illustrates a surface of LEDs and user interface elements attached to the surface of LEDs.
Figure 4:
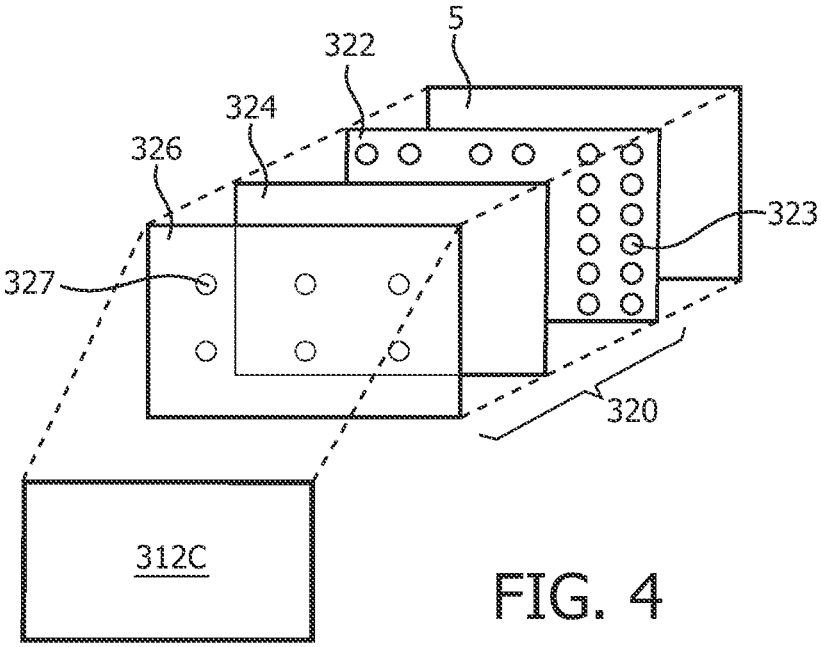
FIG. 4 illustrates an exploded perspective view of a portion of the surface of LEDs of FIG. 3 and one of the user interface elements of FIG. 3 exploded away from the example surface of LEDs.

Also, for example, with reference to FIG. 3 and FIG. 4, in some embodiments light generated by one or more LEDs of LED surface 320 may be sensed by one or more other LEDs of the LED surface 320 in identifying presence of a user interface element. FIG. 3 illustrates the user interface elements 310, 312A, 312B, and 312C coupled over the surface of LEDs 320. FIG. 4 illustrates an exploded perspective view of the portion of FIG. 3 identified with the reference numeral 4. In FIG. 4 the multiple layers of surface of LEDs 320 are illustrated exploded away from one another and from a wall 5. The user interface element 312C is also illustrated exploded away from the portion of the example surface of LEDs 320.

The surface of LEDs 320 includes a first LED layer 322, a diffuse layer 324, and a second LED layer 326. The surface of LEDs 320 may be coupled to the wall 5 or other surface. For example, in some embodiments the first LED layer 322 may be adhesively attached to the wall 5. In some other embodiments the first LED layer 322 may be cohesively formed with the wall 5. The first LED layer 322 includes a plurality of LEDs 323. In some embodiments the spacing and/or power of the LEDs 323 may be such that a substantially homogenous light emitting surface may be created when the diffuse layer 324 is atop the first LED layer 322. In some embodiments the diffuse layer 324 may include a plastic with microstructures that diffuse light output generated by LEDs 323. The diffuse layer 324 may include electrical connections and/or throughways to enable electrical connection of the second LED layer 326. The second LED layer 326 includes a plurality of LEDs 327. As illustrated, in some embodiments the LEDs 327 may be less densely populated than the LEDs 323. In some embodiments individual of the LEDs 327 may produce a greater lumen output than individual of the LEDs 323. In some embodiments the LEDS 327 may include optical elements to produce a more directional light output than the LEDs 323.

The LEDs 323 and/or 327 may be utilized as sensing LEDs to identify presence of a user interface element. For example, in some embodiments one or more of the LEDs 323 may provide light output and the LEDs 327 may operate in a sensing mode to sense light output received at the LEDs 327. Light output from LEDs 323 that is received at one of the LEDs 327 may indicate an object is present atop the LED 327 and causing some of the light output from the LEDs 323 to be reflected and/or refracted back toward that LED 327. For example, placement of the user interface element 312C atop the LEDs 327 may cause at least some of the light output from the LEDs 323 that is incident on the user interface element 312C to be reflected back toward the LEDs 327. In some embodiments at least a portion of the user interface element 312C that faces the surface of LEDs may be reflective to assist in redirecting light back toward the LEDs 327. In some embodiments a sensed light value at one or more LEDs 327 may be compared to a baseline light value indicative of anticipated light values when no object is present atop or adjacent the respective LEDs 327. In some embodiments the light generated by the LEDs 323 may be coded light to distinguish such light from other light such as ambient light.

In some embodiments identification of the user interface element may be initiated in response to a user indication of a user interface element configuration. For example, a user action may trigger the user interface element configuration. For example, actuating a button or other interface element in communication with controller 120 (e.g., on the device housing the controller 120, on a mobile electronic device (e.g., smart phone, tablet) in communication with the controller 120, other button on the LED-based lighting unit 110) may trigger the user interface element configuration.

Also, for example, in some embodiments near field communication (NFC), a radio-frequency identification (RFID) tag, and/or other radio-frequency (RF) device and/or methods may be implemented in a user interface element and/or used in combination with installation of a user interface element to initiate the user interface element configuration. For example, in some embodiments one or more RFID readers may be integrated in the LED-based lighting unit 130 and be in communication with the controller 120. In response to recognizing an RFID tag indicative of a user interface element (e.g., embedded in the user interface element 110 and/or included with installation material provided with the user interface element 110), the controller 120 may cause one or more of the LEDs of the LED-based lighting unit 130 to operate in a sensing mode and identify presence of a user interface element attached over such LEDs in response to sensed values.

In some embodiments the LEDs of a surface of LEDs may intermittently operate in a light sensing mode and monitor for attachment of a new user interface element and/or detachment of an existing user interface element (e.g., for replacing with a new user interface element or repositioning and/or reconfiguration of the existing user interface element). For example, in some embodiments one or more specific areas of a surface of LEDs may be designated for attachment of a user interface element. One or more LEDs of such areas may be utilized to at least intermittently sense light output and provide sensed values to a controller to recognize attachment and/or removal of a user interface element.

In some embodiments, NFC, a RFID tag and/or other RF apparatus and/or method may be implemented in a user interface element and/or used in combination with installation of a user interface element. The NFC, RFID tag, or other RF signal may be utilized to identify the presence of a user interface element over one or more covered LEDs. For example, in some embodiments one or more RFID readers may be integrated in the LED-based lighting unit 130 and be in communication with the controller 120. Recognition of an RFID tag indicative of a user interface element may be utilized by the controller 120 to determine that a user interface element is provided over one or more LEDs of the LED-based lighting unit 130.

In some embodiments, one or more LEDs behind an attached user interface element and/or around the user interface element may be illuminated to highlight the user interface element when it is attached to the LED surface. For example, in some embodiments a user interface element may be translucent and one or more LEDs behind the user interface element when it is attached may be illuminated to highlight the user interface element. Also, for example, in some embodiments one or more LEDs around a user interface element may be illuminated to highlight the user interface element.

At step 205 the user interface element is associated with controlled LEDs to enable control of the controlled LEDs by the user interface element. In some embodiments the user interface element is associated with the controlled LEDs based on the attachment location of the user interface element. For example, with reference to FIG. 1, attaching the user interface element 110 anywhere over the LEDs of the LED-based lighting unit 130 may associate the user interface element 110 with the LEDs of the LED-based lighting unit 130. For example, the user interface element 110 may be associated with control of all of the LEDs of the LED-based lighting unit 130. Also, for example, the user interface element 110 may be associated with control of all of the LEDs of the LED-based lighting unit 130 that are not covered by the user interface element 110. Also, for example the user interface element 110 may be associated with control of a grouping of the LEDs of the LED-based lighting unit 130 that are associated with the LEDs over which the user interface element 110 is provided. For example, placing the user interface element 110 over a plurality of first LEDs may associate the user interface element 110 with a first grouping of LEDs whereas placing the user interface element 110 over a plurality of second LEDs may associate the user interface element 110 with a second grouping of LEDs.

In some embodiments, the controlled LEDs associated with the user interface element 110 may be determined based on proximity of the controlled LEDs with the user interface element 110. For example, in some embodiments the user interface element may be an annular user interface element and the controlled LEDs associated with the user interface element may be one or more LEDs that are determined to be located interiorly of the annular user interface element. Also, for example, in some embodiments the controlled LEDs associated with the user interface element may be one or more LEDs over which the user interface element is provided, one or more LEDs that surround the user interface element, and/or one or more LEDs that are within a certain distance of the user interface element. In some embodiments the controller 120 may consult a mapping (e.g., stored in memory associated with controller 120) between the LED(s) over which the user interface element 110 is attached and other LEDs of the LED-based lighting unit 130 to determine which LEDs to associate with the user interface element 110 to enable control of those LEDs by the user interface element 110. In some embodiments the controlled LEDs may be on a different surface than the surface to which the user interface element is attached. For example, in some embodiments a user interface element may be attached on an LED surface on a first side of a wall and may be associated with LEDs on a second side of the wall (e.g., LEDS opposite the user interface element). Also, for example, in some embodiments a user interface element may be attached on an LED surface on a column and may be associated with LEDs in a ceiling (e.g., a wall that is near the column).

In some embodiments, the user interface element is associated with the controlled LEDs based on placement of the user interface element in proximity to the controlled LEDs before and/or after placement of the user interface element in its desired installation location. For example, as described herein, in some implementations a user interface element configuration may be initiated (e.g., in response to a user action and/or recognition of an RF signal from a user interface element). During the user interface element configuration the user may place the user interface element in proximity to the desired controlled LEDs. Placement of the user interface element in proximity to the desired controlled LEDs may provide an indication that the user desires to control such LEDs with the user interface element.

In some embodiments, the user interface element may include NFC, an RFID tag, and/or other RF device that may interface with one or more corresponding RF devices associated with the controlled LEDs to provide an indication that the user wishes to control such LEDs. For example, the LED-based lighting unit 130 may include a plurality of RFID readers each corresponding with a grouping of LEDs of the LED-based lighting unit 130 and each in communication with controller 120. After a user interface element configuration is initiated, the user may place the user interface element 110 in proximity to a desired grouping of LEDs to control, an RFID tag of the user interface element 110 may be read by one of the RFID readers, and indication of the RFID tag being read provided to the controller 120. In response, the controller 120 may associate the user interface element 110 with the LEDs that are associated with the RFID reader.

In some embodiments, the user interface element may be placed over the LEDs to be controlled during the user interface element configuration and one or more of the LEDs to be controlled may operate in a sensing mode to identify the presence of the user interface element. For example, after a user interface element configuration is initiated, the user may place the user interface element 110 in proximity to a desired grouping of LEDs to control, one or more of the LEDs may be operated in a sensing mode and identify presence of the user interface element 110, and indication of presence of the user interface element 110 provided to the controller 120. In response, the controller 120 may associate that grouping of the LEDs with the user interface element 110 for the user interface element 110 to control that grouping of the LEDs. The user interface element 110 may then optionally be attached in another location for user interaction to control the LEDs.

In some embodiments, an electronic device such as a smartphone and/or tablet may be utilized to associate the user interface element with controlled LEDs. For example, as described herein, in some implementations a user interface element configuration may be initiated (e.g., in response to a user action and/or recognition of an RF signal). During the user interface element configuration the user may utilize the electronic device to identify which of a plurality of LEDs will be controlled by the user interface element. For example, after attachment of the user interface element 110, the controller 120 may communicate with a mobile electronic device to associate the user interface element 110 with a grouping of LEDs. The mobile electronic device may select the grouping of LEDs from predefined groupings and/or create the grouping. In some embodiments LED groupings may be illuminated to provide the user an indication of options for controlled LEDs. For example, in response to attachment of a user interface element, LED groupings may be sequentially illuminated and a user may choose one of the LED groupings via an electronic device while a desired of the LED groupings is illuminated.

Figure 9:
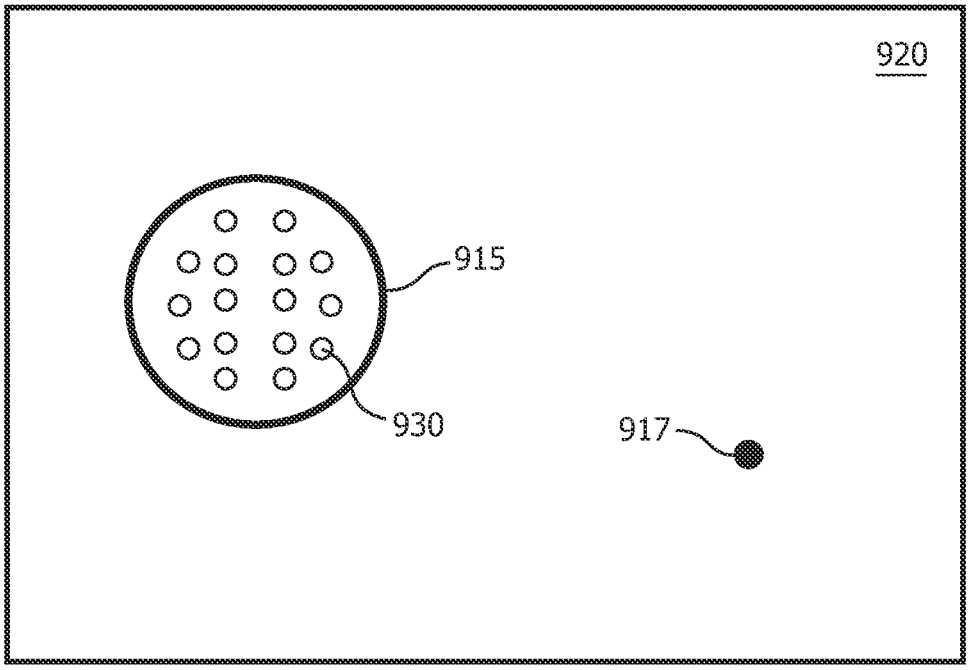
FIG. 9 illustrates a surface of LEDs and attachable elements attached to the surface of LEDs.

In some embodiments, the user interface element may be associated with one or more controlled LEDs via association with one or more optical elements that have been associated with the one or more controlled LEDs. For example, in some embodiments an attachable optical element may be attached over one or more LEDs and associated with one or more LEDs based on the LEDs over which the optical element is attached. For example, in some embodiments the optical element may be annular and attached over a plurality of LEDs. The optical element may be associated with the LEDs that are located interiorly of the annular optical element. In some embodiments the association with the LEDs located interiorly of the annular optical element may be based on sensing of the optical element by one or more LEDs over which the optical element is located and associating LEDs interiorly of such one or more LEDs with the optical element. One example of such an attachable optical element is illustrated by attachable element 915 in FIG. 9.

Also, for example, in some embodiments an optical element may be attached over one or more LEDs and associated with the one or more LEDs over which the optical element is attached. For example, the optical element may be a directional optical element that redirects light output from LEDs over which it is provided in one or more directions. In some embodiments the association with the LEDs over which the optical element is provided may be based on sensing of the optical element by one or more LEDs over which the optical element is located while the LEDs are in a sensing mode.

In some embodiments, associating the one or more optical elements with the UI element may be based on correlation between an identifier of the user interface element and an identifier of the optical element(s). Identification of the identifier for the user interface element and/or the optical element(s) may be based on one or more apparatus or methods such as one or more apparatus and/or methods described herein in conjunction with the user interface element. For example, in some embodiments RFID, NFC, shape, and/or other readings may be utilized to identify the identifier of the user interface element and/or the optical element(s). In some embodiments associating an optical element with the user interface element may be based on proximity in time within which the two are attached and/or proximity of the locations at which the two are attached. For example, a user interface element may be associated with one or more of the locationally closest optical elements. Also, for example, a user interface element may be associated with one or more of the optical elements attached closest in time before and/or after the user interface element.

Also, for example, a configuration phase may be utilized whereby when an optical element is placed on a LED surface and the part of the LED surface associated with the optical element flashes for a certain time period (e.g., a minute). Within that time period the optical element may be associated with a user interface element. This may be done, for example, by attaching a user interface element or by user interaction with an already attached user interface element (e.g., activating a "light source on" state of the user interface element). Upon association of the optical element and the user interface element, the LEDs associated with the optical element may flash a number of times to indicate to the user that the optical element and the associated LEDs are now associated with the user interface element.

At step 210, at least one lighting control property of the user interface element is identified. The lighting control property may be based on one or more property identifiable from the user interface element. In some embodiments the lighting control properties of a user interface element may be the same regardless of installation location and/or controlled LEDs associated with the user interface element. In some embodiments the lighting control properties of a user interface element may be based at least in part on one or more installation particulars such as, for example, installation location, controlled LEDs that are associated with the user interface element, position and/or lighting control properties of other user interface element(s). In some embodiments the lighting control properties of a user interface element may be based on user input. In some embodiments a controller may verify that lighting control properties intended for adjustment by the user interface element may be effectuated via the controlled light sources.

In some embodiments, the lighting control property is identified based on LEDs over which the user interface element is provided. For example, the shape and/or size of the user interface element may be determined based on which of a plurality of LEDs have sensed the presence of the user interface element. The shape and/or size may be indicative of a certain lighting control property. For example, with reference to FIG. 3, the shape and/or sizes of user interface elements 310 and 312A-C may be determined based on which of the LEDs of LED surface 320 sensed the user interface elements thereover and the shape and/or sizes may be indicative of the lighting control properties of the user interface elements. For example, the shape and size of user interface element 310 may indicate that the user interface element 310 is an "on/off" switch that turns one or more light sources on or off upon actuation thereof. Also, for example, the shape and size of user interface elements 312A-C may indicate that they are each a "light level" switch that each adjusts one or more light sources to a given light level upon actuation thereof.

Figure 5:
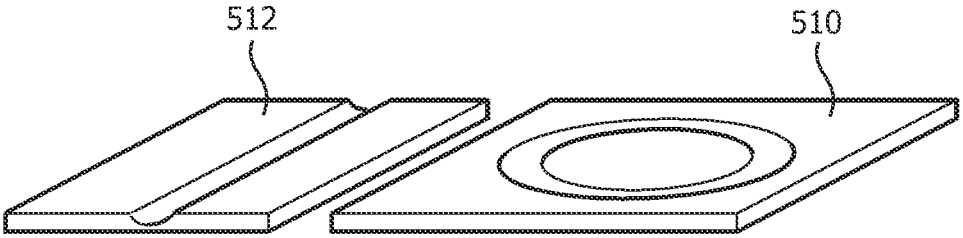
FIG. 5 illustrates perspective views of two example user interface elements.

Also, for example, with reference to FIG. 5, the shape and/or size of the user interface element 510 may indicate that the user interface element 510 is an "on/off" switch that turns one or more light sources on or off upon actuation thereof. The user interface element 510 also includes an annular indentation in the surface thereof that may provide a visual and/or tactile indication of its functionality. Also, for example, the shape and/or size of the user interface element 512 may indicate that the user interface element 512 is a "slider" that adjusts brightness, color, and/or other property of one or more light sources upon sliding actuation along a length thereof. The user interface element 512 also includes a linear indentation in the surface thereof that may provide a visual and/or tactile indication of its functionality.

In some embodiments, the lighting control property is identified based on which other user interfaces are provided and/or the location of those other user interfaces. For example, the shape and size of user interface elements 312A-C may indicate that they are each a "light level" switch that each adjusts one or more LEDs to a given light level upon actuation thereof. Identification of there being three separate user interface elements 312A-C may indicate that three different light levels should be provided (e.g., low, medium, and high), with actuation of each of the interface elements 312A-C providing one of those light levels. Also, for example, the positioning of the interface elements 312A-C relative to one another and/or relative to the user interface element 310 may indicate that: actuation of the user interface element 312A should provide the lowest light level; actuation of the user interface element 312B should provide the middle light level; and actuation of the user interface element 312C should provide the highest light level.

In some embodiments shape, size, and/or placement of the user interface element may be utilized to identify a lighting control property of the user interface element when the user interface element is a passive user interface element. A passive user interface element is a user interface element that does not require power and that does not have any self-contained sensing capabilities.

In some embodiments the lighting control property is identified based one or more property identifiable via an RF device of the user interface element. For example, the user interface element may include NFC, an RFID tag, and/or other RF device that may interface with one or more corresponding RF devices associated with the controlled LEDs to provide an indication of one or more lighting control properties of the user interface element. For example, the RF device may provide a readable code that may be correlated with a corresponding user interface functionality that enables control of one or more lighting properties. For example, the LED-based lighting unit 130 may include a plurality of RFID readers each corresponding with a grouping of LEDs of the LED-based lighting unit 130 and each in communication with controller 120. After a user interface element configuration is initiated, an RFID tag of the user interface element 110 may be read by one of the RFID readers and indication of the functionality of the user interface element provided to the controller 120 based on the RFID tag. In response, the controller 120 may associate the user interface element 110 with the one or more indicated lighting control properties.

Figure 6:
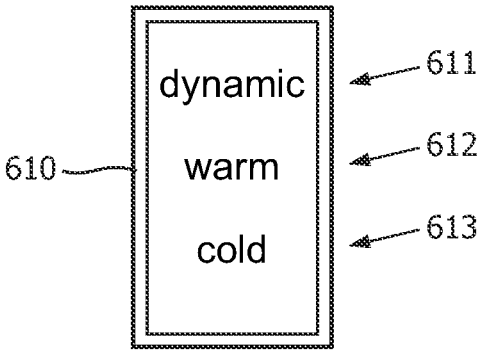
FIG. 6 illustrates another example of a user interface element.

Also, for example, with reference to FIG. 6, the user interface element 610 may include an RFID tag that indicates: actuation of the user interface element in the dynamic area 611 activates one or more light sources in a dynamic state upon actuation thereof; actuation of the user interface element in the warm area 612 activates one or more light sources to generate light output of a warm color temperature upon actuation thereof; and actuation of the user interface element in the cold area 613 activates one or more light sources to generate light output of a cool color temperature upon actuation thereof. The required light source settings may be based on information provided by the user interface element and/or may be based on light source capabilities of the corresponding controlled light sources.

In some embodiments, an electronic device such as a smartphone and/or tablet may be utilized to provide an indication of one or more lighting control properties of the user interface element. For example, as described herein, in some implementations a user interface element configuration may be initiated (e.g., in response to a user action and/or recognition of an RF signal). During the user interface element configuration the user may utilize the electronic device to identify one or more control properties of the user interface element.

Figure 7:
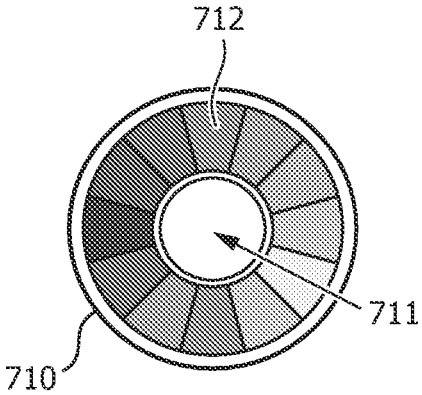
FIG. 7 illustrates another example of a user interface element.

For example, with reference to FIG. 7, a controller may communicate with a mobile electronic device to identify lighting control properties of the user interface element 710. The mobile electronic device may select the lighting control properties from predefined lighting control properties and/or specify the lighting control properties. For example, in some embodiments the user interface element 710 may be identified utilizing the mobile electronic device (e.g., via a camera of the mobile electronic device and/or NFC of the mobile electronic device) and a plurality of predefined lighting control properties presented to the user. The lighting control properties may be based on the identification of the user interface element 710 and/or the capabilities of the controlled LEDs controlled by the user interface element 710.

For example, a first predefined lighting control property for the user interface element 710 may indicate that actuation of the user interface element 710 in the central area 711 turns one or more light sources on or off upon actuation thereof and that actuation of the user interface element 710 in the annular area 712 provides adjustment of color temperature, wherein the color temperature corresponds to the actuation location. Also, for example, a second predefined lighting control property for the user interface element 710 may indicate that actuation of the user interface element 710 in the central area 711 turns one or more light sources on or off upon actuation thereof and that actuation of the user interface element 710 in the annular area 712 provides adjustment of light output intensity, wherein the light output intensity corresponds to the actuation location. Additional and/or alternative lighting control configurations may be defined. For example, adjustment of one or more lighting control properties may be based on sliding actuation around the annular area 712.

At step 215, user interaction with the user interface element is identified. In some embodiments the user interaction with the user interface element may be based on sensing of the user interaction via one or more of the LEDs over which the user interface element is located. For example, with reference to FIG. 4, the user interface element 312C may be translucent and/or transparent and one or more of the LEDs 327 may be in a sensing mode. User interaction with the user interface element 312C may alter the light levels sensed by the one or more LEDs 327 by at least a threshold amount and that alteration of the light levels sensed by the one or more LEDs 327 may be identified by a controller as a user actuation of the user interface element 312C. In some embodiments user interaction with the user interface element may be based on sensing of the user interaction via one or more of the LEDs when the user interface element is a passive user interface element.

For example, in some embodiments one or more of the LEDs 323 may provide light output and the LEDs 327 may operate in a sensing mode to sense light output received at the LEDs 327. Placement of a user's finger over or on the LEDs 327 may cause at least some of the light output from the LEDs 323 that is incident on the user's finger to be reflected back toward the LEDs 327. In some embodiments a sensed light value at one or more LEDs 327 may be compared to a light value indicative of light values when a user's finger is not placed atop the user interface element 312C. In some embodiments the light generated by the LEDs 323 may be coded light to distinguish such light from other light such as ambient light.

Also, for example, in some embodiments one or more LEDs 327 may sense occlusion of ambient light and/or other light that is incident on LEDs 327 through the user interface element 327. The occlusion may be the result of a user interaction with the user interface element. Such sensed occlusion data may be compared to a light value indicative of light values when a user's finger is not placed atop the user interface element 312C to identify a user interaction. In some embodiments the light value indicative of light values when a user's finger is not placed atop the user interface element 312C may be one or more sensed values that are recent in time to the user interaction to account for changing ambient and/or other light values.

In some embodiments, the user interaction sensed by LEDs may be a touch of the user interface element. In some embodiments user interactions beyond simply a touch of the user interface element may be identified by sensing LEDs. For example, the duration of a touch may be identified based on the length of time of the change in sensed light values at one or more sensing LEDs. The duration of the touch may be utilized to adjust one or more lighting properties. For example, in some embodiments a touch beyond a certain duration will dim one or more controlled light sources, wherein the extent of dimming is dependent on the duration of the touch. Also, for example, the direction of a touch may be identified based on comparison of sensed light values at a plurality of sensing LEDs. For example, user interface element 512 may be installed over a plurality of LEDs and control a dimming light output property of one or more light sources. A user may slide his finger "up" the user interface element 512 to increase the light output and slide his finger "down" the user interface element 512 to decrease the light output. Sensed light values over time at LEDs along the length of the user interface element may be analyzed to determine the direction of the sliding of the user's finger.

In some embodiments, the user interaction may be sensed by the user interface element and provided by the user interface element to a controller. For example, in some embodiments the user interaction is sensed by the user interface and indication of the user interaction is communicated to a controller by the user interface element utilizing RF. For example, the user interface element may provide a readable code that may be correlated with a corresponding user interaction.

In some embodiments, some interactions with a user interface element may be sensed by the user interface element and provided by the user interface element to a controller and other interactions with the user interface element may be sensed by LEDs over which the user interface element is provided. For example, user interactions with the central area 711 of user interface element 710 may be sensed by one or more LEDs behind the central area 711 and user interaction with the user interface element 710 in the annular area 712 may be sensed by the user interface element 710.

The user interface element may be coupled to a power source to enable identification of a user interaction and/or transmission of an indication of a user interaction or other data to the controller. For example, in some embodiments the user interface element may be coupled to a battery. Also, for example, in some embodiments the user interface element may include a light harvesting panel that harvests available light to provide power for the user interface element. For example, in some embodiments the light harvesting panel may face one or more LEDs over which the user interface element is provided and the LEDs may be powered at least intermittently to provide power to the user interface element. For example, the user interface element 312C may include a light harvesting panel on a rear surface thereof that harvests light from one or more LEDs (e.g., LEDs 323 and/or 327) that are generating light output behind the user interface element 312C.

Also, for example, in some embodiments the user interface element may be powered inductively. For example, small coils may be embedded in the LED surface over which the user interface element is attached and may be utilized to inductively power the user interface element. Also, for example, in some embodiments the user interface element may be powered capacitively. For example, an electromagnetic field, such as the electromagnetic field utilized for communication between the controller and the user interface element, may be utilized to power the user interface element. Additional and/or alternative apparatus and methods may be utilized to power a user interface element, when the user interface element requires power. In some embodiments those apparatus and/or methods may enable powering of the user interface element independently of requiring a connection to the mains power supply.

At step 220 at least one property of the controlled LEDs is adjusted in response to the user interaction with the user interface element that was identified at step 215. For example, in response to user interaction with a user interface element having an on/off lighting control property, the controlled LEDs controlled by the user interface element may either be switched on or off. Also, for example, in response to user interaction with an aspect of a user interface element that adjusts color temperature, the color temperature of the controlled LEDs controlled by the user interface element may be adjusted. One or more controllers and/or drivers in communication with the controlled LEDs may effectuate the adjustment to the controlled LEDs in response to the user interaction with the user interface element.

In some embodiments, the user interface element may additionally and/or alternatively control other systems and/or devices that are in communication with the LED network. For example, controller 120 may be in communication with additional devices and transmit one or more control signals to the devices and/or to other controllers controlling such additional devices. In some embodiments the additional devices and/or control systems could be communicating via a standardized protocol such as the KNX standard. Additional devices that may be controlled include, for example, blinds or other shading that may adjusted to provide adjustable ambient light input from windows, heating or cooling systems, alarm systems, and/or media systems such as televisions and audio equipment.

In embodiments where the user interface element may be utilized to additionally or alternatively control a different system and/or device, step 205 may include associating the user interface element with such system or device and step 210 may include identifying at least one system or device control property of the user interface element. In some embodiments user interaction with the user interface element will result in the controller associated with the LED surface sending the user commands to such system or device. In some embodiments the user interface element might wirelessly communicate with the dedicated system, but use the LED surface for powering the user interface element and/or highlighting the user interface.

Figure 8:
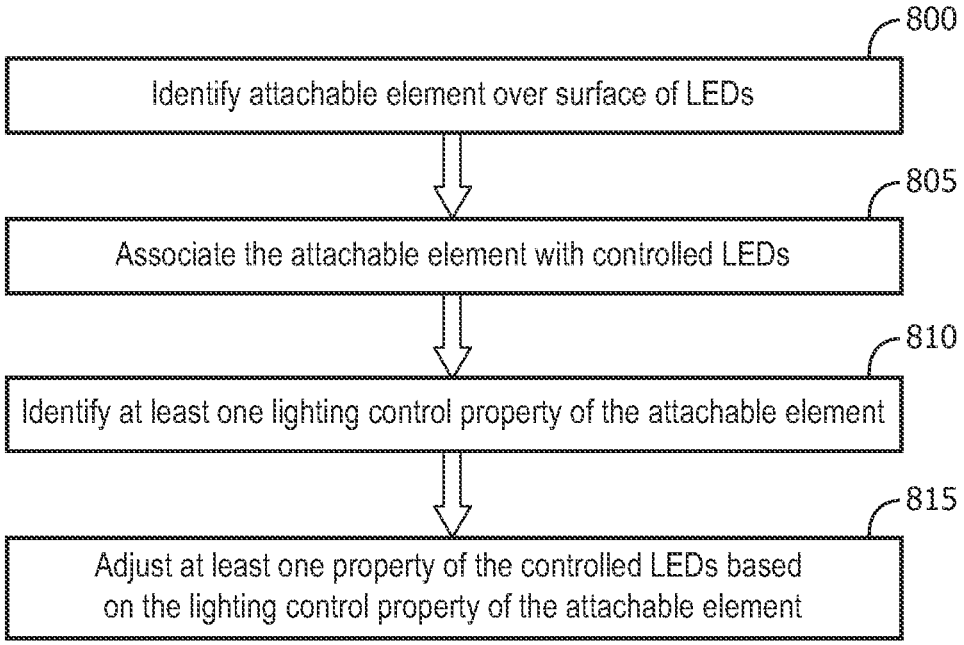
FIG. 8 illustrates a flow chart of an example method of adjusting at least one light source in response to an attachable element.

FIG. 8 illustrates a flow chart of an example method of adjusting at least one light source in response to an attachable element. Other implementations may perform the steps in a different order, omit certain steps, and/or perform different and/or additional steps than those illustrated in FIG. 8. For convenience, aspects of FIG. 8 will be described with reference to one or more components of a lighting system that may perform the method. The components may include, for example, one or more of the components of FIG. 9. Accordingly, for convenience, aspects of FIG. 9 will be described in conjunction with FIG. 8.

Generally speaking, an attachable element is a specific type of optical element where the attachment location and at least one property of the element are used to enable a particular light effect relative to the attachment location. When such an attachable element is detected via a surface of LEDs, the particular light effect is enabled. In some embodiments once attached, further user interactions with the attachable element may not alter the particular light effect. In some embodiments detachment and reattachment of the attachable element at another location may alter the particular light effect.

At step 800 an attachable element coupled over a surface of LEDs is identified. Identification of the attachable element over the surface of LEDs may share one or more characteristics with step 200 of the method of FIG. 2. For example, with reference to FIG. 9, the attachable element 915 may be coupled over one or more of the LEDs of the LED surface 920 and presence thereof identified. Also, for example, the attachable element 917 may be coupled over one or more of the LEDs of the LED surface 920 and presence thereof identified. In some embodiments the attachable element attachment location may be indicated. In some embodiments the attachable element may include an adhesive that enables adhering to the surface of LEDs.

In some embodiments, one or more of the LEDs of the surface of LEDs may be utilized to identify the attachable element. For example, sensed light values of one or more sensing LEDs may be indicative of whether an attachable element is attached to the LED surface over such LEDs. In some embodiments at least one sensed light value of one or more LEDs may be compared to at least one or more threshold light values (e.g., empirical and/or measured in a calibration mode with no user interface elements present) to determine whether an attachable element is attached to the LED surface.

In some embodiments, identification of the attachable element may be initiated in response to a user indication of an attachable element configuration. For example, a user action may trigger the attachable element configuration. For example, actuating a button or other interface element in communication with a controller of the surface of LEDs 920 may trigger the attachable element configuration for attachable elements 915 and/or 917.

In some embodiments, near field communication (NFC), a radio-frequency identification (RFID) tag, and/or other radio-frequency (RF) device and/or methods may be implemented in an attachable element and/or used in combination with installation of an attachable element. Recognition of the RFID tag may initiate the attachable element configuration.

At step 805 the attachable element is associated with one or more controlled LEDs to control the controlled LEDs in response to attachment of the attachable element. Association of the attachable element with one or more controlled LEDs may share one or more characteristics with step 205 of the method of FIG. 2. In some embodiments the attachable element is associated with the controlled LEDs based on the attachment location of the attachable element. For example, with reference to FIG. 9, attaching the attachable element 915 in its illustrated location associates those LEDs 930 of LED surface 920 located interiorly of the attachable element 915 with the attachable element 915. Also, for example, with reference to FIG. 9, attaching the attachable element 917 in its illustrated location associates LEDs located on another LED surface (e.g., ceiling or another wall) and that are directed at the attachable element 917 with the attachable element 917. Also, for example, attaching an attachable element on a first side of a LED surface may associate LEDs located on another side of the LED surface (e.g., LEDS opposite the attachable element) with the attachable element. In some embodiments a controller may consult a mapping (e.g., stored in memory associated with the controller) between the LED(s) over which the attachable element is attached and other LEDs to determine which LEDs to associate with the attachable element.

In some embodiments, the association of the attachable element with controlled LEDs may be dependent on the identified lighting control property identified in step 810. For example, the identified lighting control property for attachable element 915 may be to illuminate all LEDs located interiorly of attachable element 915. Based on this lighting control property the controlled LEDs can be identified by determining which of the LEDs are located interiorly of the attachable element 915. For example, the controlled LEDs may be identified based on identification of LEDs that sense the attachable element 915 and identifying LEDs located interiorly thereof as the controlled LEDs (e.g., by reference a mapping of the LEDs).

In some embodiments, the attachable element may include NFC, an RFID tag, and/or other RF device that may interface with one or more corresponding RF devices associated with the controlled LEDs to provide an indication that the user wishes to control such LEDs. For example, the surface of LEDs 920 and/or other adjacent LEDs may include a plurality of RFID readers each corresponding with a grouping of LEDs of the surface of LEDs 920 and each in communication with a controller. After an attachable element configuration is initiated, the user may place the attachable element in proximity to a desired grouping of LEDs to control, a RFID tag of the attachable element may be read by one of the RFID readers, and indication of the RFID tag being read provided to the controller. In response, the controller may associate the attachable element with the LEDs that are associated with the RFID reader.

In some embodiments, an electronic device such as a smartphone and/or tablet may be utilized to associate the attachable element with controlled LEDs. For example, as described herein, in some implementations an attachable element configuration may be initiated (e.g., in response to a user action and/or recognition of an RF signal). During the attachable element configuration the user may utilize the electronic device to identify which of a plurality of LEDs will be controlled in response to attachment of the attachable element. For example, after attachment of the attachable element 917, a controller may communicate with a mobile electronic device to associate the attachable element 917 with one or more LEDs having light output directable at the attachable element 917.

At step 810 at least one lighting control property of the attachable element is identified. Identification of the lighting control property of the attachable element may share one or more characteristics with step 210 of the method of FIG. 2. The lighting control property may be based on one or more property identifiable from the attachable element. In some embodiments the lighting control properties of an attachable element may be the same regardless of installation location and/or controlled LEDs associated with the attachable element. In some embodiments the lighting control properties of an attachable element may be based at least in part on one or more installation particulars such as, for example, installation location, controlled LEDs that are associated with the attachable element, and/or position and/or lighting control properties of other attachable element. In some embodiments the lighting control properties of an attachable element may be based on user input.

In some embodiments, the lighting control property is identified based on LEDs over which the attachable element is provided. For example, the shape and/or size of the attachable element may be determined based on which of a plurality of LEDs have sensed the presence of the user interface element. The shape and/or size of may be indicative of a certain lighting control property. For example, with reference to FIG. 9, the annular shape and/or the size of attachable element 915 may be determined based on which of the LEDs of LED surface 920 sensed the attachable element 915 thereover and the shape and/or size may be indicative of the lighting control property of the attachable element 915. For example, the shape and size of user attachable element 915 may indicate that any light sources located interiorly thereof should be illuminated upon attachment thereof. Also, for example, with reference to FIG. 9, the circular shape and/or the size of attachable element 917 may be determined based on which of the LEDs of LED surface 920 sensed the attachable element 917 thereover and the shape and/or size may be indicative of the lighting control property of the attachable element 917. For example, the shape and size of user attachable element 917 may indicate that any light sources having a light output directed at the attachable element 917 should be illuminated upon attachment thereof.

In some embodiments, the lighting control property is identified based one or more property identifiable via an RF device of the attachable element. For example, the attachable element may include NFC, an RFID tag, and/or other RF device that may interface with one or more corresponding RF devices associated with the controlled LEDs to provide an indication of one or more lighting control properties of the attachable element. In some embodiments an electronic device such as a smartphone and/or tablet may be utilized to provide an indication of one or more lighting control properties of the attachable element. For example, as described herein, in some implementations an attachable interface element configuration may be initiated (e.g., in response to a user action and/or recognition of an RF signal). During the attachable element configuration the user may utilize the electronic device to identify one or more control properties of the attachable element.

At step 815 at least one property of the controlled LEDs is adjusted based on the lighting control property of the attachable element. The at least one property of the controlled LEDs may be adjusted in response to attachment of the attachable element. For example, in response to attachment of the attachable element 915 the LEDs 930 interiorly thereof may be illuminated. Also, for example, in response to attachment of attachable element 917, one or more light sources directed at attachable element 917, such as LEDs on another LED surface, may be illuminated and directed at attachable element 917. In some embodiments the adjustment to the controlled LEDs may be removed upon removal of respective of the attachable elements 915 and/or 917. In some embodiments the adjustment to the controlled LEDs may be maintained even after removal of the attachable elements 915 and/or 917. For example, the LEDs 930 interiorly of attachable element 915 may remain illuminated even after removal of attachable element 915. In some of those embodiments the adjustment may be eliminated, for example, upon reattachment of the attachable element 915 at another location, or upon reconfiguration of the surface of LEDs 920. One or more controllers and/or drivers in communication with the controlled LEDs may effectuate the adjustment to the controlled LEDs.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

Also, reference numerals appearing between parentheses in the claims, if any, are provided merely for convenience and should not be construed as limiting the claims in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A method of associating a user interface element with at least one light source, comprising:

identifying presence of a user interface element over one or more covered LEDs of a plurality of LEDs;

associating the user interface element with control of controlled LEDs of the LEDs based on the presence identification of the user interface element;

identifying at least one lighting control property of the user interface element, wherein the identifying at least the lighting control property of the user interface element is based on sensing of at least one physical characteristic of the user interface element via at least one of the covered LEDs;

identifying a user interaction with the user interface element; and adjusting at least one property of the controlled LEDs in response to the user interaction with the user interface element, wherein the adjusting of the controlled LEDs is based on the lighting control property of the user interface element;

wherein the user interface element is attachable over the covered LEDS.

2. The method of claim 1, wherein the step of identifying the user interaction with the user interface element includes sensing of the user interaction with the user interface element by at least one of the covered LEDs.

3. The method of claim 1, wherein the step of identifying the user interaction with the user interface element includes receiving user interaction data from the user interface element in response to the user interaction with the user interface element.

4. The method of claim 1, wherein the physical characteristic includes at least one of size and shape of the user interface element.

5. The method of claim 1, wherein the step of associating the user interface element with control of controlled LEDs is based on proximity of the user interface element to the controlled LEDs.

6. The method of claim 1, wherein the step of associating the user interface element with control of controlled LEDs is based on association of the covered LEDs with the controlled LEDs.

7. The method of claim 1, wherein the step of associating the user interface element with control of controlled LEDs is based on at least one physical characteristic of the user interface element.

8. The method of claim 7, wherein the at least one physical characteristic is a radio-frequency tag.

9. The method of claim 1, wherein the step of associating the user interface element with control of the controlled LEDs includes:

initiating a configuration phase;

providing a visual indication of the controlled LEDs during the configuration phase; and receiving a configuration confirmation in response to the visual indication of the controlled LEDs during the configuration phase, the configuration confirmation indicative of associating the user interface element with control of the controlled LEDs.

10. The method of claim 9, wherein the configuration confirmation is received via the user interface element.

11. The method of claim 1, further comprising illuminating the user interface element with at least one of the covered LEDs.

12. A method of adjusting at least one light source in response to an attachable element, comprising:

identifying presence of an attachable element over one or more covered LEDs of a plurality of LEDs;

associating the attachable element with controlled LEDs of the LEDs based on the presence identification of the attachable element;

identifying at least one lighting control property of the attachable element based on sensing of at least one physical characteristic of the attachable element by at least one of the covered LEDs; and adjusting at least one property of the controlled LEDs based on the at least one lighting control property of the attachable element.

13. The method of claim 12, wherein the physical characteristic includes at least one of size and shape of the attachable element.

14. The method of claim 12, wherein the step of associating the attachable element with the controlled LEDs is based on proximity of the attachable element to the controlled LEDs.

15. The method of claim 12, wherein the step of associating the attachable element with control of controlled LEDs is based on association of the covered LEDs with the controlled LEDs.

16. The method of claim 12, wherein the step of associating the attachable element with the controlled LEDs is based on of at least one physical characteristic of the attachable element.

17. The method of claim 12, further comprising identifying a user interaction with the attachable element, and wherein the adjusting at least one property of the controlled LEDs is in response to the user interaction with the user interface element.

18. A lighting apparatus including a memory and a controller operable to execute instructions stored in the memory, comprising instructions to:

identify presence of a user interface element over one or more covered LEDs of a plurality of LEDs;

associate the user interface element with control of controlled LEDs of the LEDs based on the presence identification of the user interface element;

identify at least one lighting control property of the user interface element based on sensing of at least one physical characteristic of the user interface element via at least one of the covered LEDs;

identify a user interaction with the user interface element; and adjust at least one property of the controlled LEDs in response to the user interaction with the user interface element, wherein the adjusting of the controlled LEDs is based on the lighting control property of the user interface element;

wherein the user interface element is attachable over the covered LEDs.

19. A lighting system comprising:

at least one light source generating lighting having at least one adjustable lighting property;

at least one sensing LED configured to sense presence of a user interface element; and at least one controller in electrical communication with said light source and said sensing LED;

wherein said at least one controller:

identifies presence of the user interface element based on input from the at least one sensing LED;

associates the user interface element with control of the light source based on the presence identification of the user interface element;

identifies at least one lighting control property of the user interface element based on sensing of at least one physical characteristic of the attachable element by at least one of the covered LEDs;

identifies a user interaction with the user interface element; and adjusts at least one property of the controlled LEDs in response to the user interaction with the user interface element, wherein the adjusting of the controlled LEDs is based on the lighting control property of the user interface element.

* * * * *